US010551140B2

(12) United States Patent
Patrick, IV

(10) Patent No.: US 10,551,140 B2
(45) Date of Patent: Feb. 4, 2020

(54) FIREARM WITH ELECTRONIC IGNITION

(71) Applicant: James Robert Patrick, IV, Charles Town, WV (US)

(72) Inventor: James Robert Patrick, IV, Charles Town, WV (US)

( * ) Notice: Subject to any disclaimer, the term of this patent is extended or adjusted under 35 U.S.C. 154(b) by 0 days.

(21) Appl. No.: 16/169,197

(22) Filed: Oct. 24, 2018

(65) Prior Publication Data

US 2019/0137207 A1 May 9, 2019

Related U.S. Application Data

(60) Provisional application No. 62/581,035, filed on Nov. 3, 2017.

(51) Int. Cl.

| | |
|---|---|
| ***F41A 19/59*** | (2006.01) |
| ***F41A 19/68*** | (2006.01) |
| ***F41F 1/08*** | (2006.01) |
| ***F41A 9/35*** | (2006.01) |
| ***F41A 21/08*** | (2006.01) |
| ***F41A 19/58*** | (2006.01) |
| ***F41C 3/00*** | (2006.01) |

(52) U.S. Cl.

CPC ..... *F41A 19/59* (2013.01); *F41A 9/35* (2013.01); *F41A 19/58* (2013.01); *F41A 19/68* (2013.01); *F41A 21/08* (2013.01); *F41C 3/00* (2013.01); *F41F 1/08* (2013.01)

(58) Field of Classification Search

USPC ..... 89/1.41, 126, 127

See application file for complete search history.

(56) References Cited

U.S. PATENT DOCUMENTS

| | | | | |
|---|---|---|---|---|
| 2,353,601 A * | 7/1944 | Tisdale, Sr. | F41A 9/35 | 102/438 |
| 2,436,175 A * | 2/1948 | Neal | F41A 3/26 | 42/16 |
| 3,720,133 A * | 3/1973 | Jampy | F41A 9/35 | 42/50 |
| 4,867,039 A * | 9/1989 | Dobbins | F41A 9/35 | 89/127 |
| 10,060,689 B2 | 8/2018 | Grier | | |
| 2012/0291324 A1* | 11/2012 | Bandini | F41A 9/68 | 42/14 |

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

Firearms with electronic ignitions have a frame defining an ammunition receptacle having an open lower end and a closed upper end and opposed lateral sidewalls, a plurality of barrels connected to the frame, each barrel having a rear end aperture providing communication with the ammunition receptacle, an ammunition cartridge adapted to be closely and removably received in the ammunition receptacle in an operation position between the opposed lateral sidewalls, the ammunition cartridge having a plurality of ammunition elements, and each ammunition element being registered with a corresponding one of the barrels. Each ammunition element may include a chamber tube element containing propellant and projectile. Each chamber tube element may include a pressure containment member adapted to contain pressures associated with discharge. Each barrel may define a barrel axis, and the barrel axes may be parallel to each other. The ammunition receptacle may be an elongated passage.

25 Claims, 4 Drawing Sheets

FIREARM WITH ELECTRONIC IGNITION

CROSS-REFERENCE TO RELATED APPLICATION

This application claims the benefit of U.S. Provisional Patent Application No. 62/581,035 filed on Nov. 3, 2017, entitled "FIREARM WITH ELECTRONIC IGNITION," which is hereby incorporated by reference in its entirety for all that is taught and disclosed therein.

FIELD OF THE INVENTION

The present invention relates to firearms and more particularly to a firearm with electronic ignition.

BACKGROUND OF THE INVENTION

Shotguns are smoothbore firearms used by civilians, law enforcement, and military personnel. The limitations of shotguns include a large size, significant weight, a low rate of fire, and a complex reloading sequence. Additionally, less-lethal ammunition that is fired from shotguns can cause unintended damage if the target is too close to the muzzle. When less-lethal ammunition is used, the shooter is tasked with estimating the distance to a target without the aid of a measuring instrument.

Therefore, a need exists for a new and improved firearm with electronic ignition that is compact, light, and can be loaded and fired rapidly. In this regard, the various embodiments of the present invention substantially fulfill at least some of these needs. In this respect, the firearm with electronic ignition according to the present invention substantially departs from the conventional concepts and designs of the prior art, and in doing so provides an apparatus primarily developed for the purpose of providing a firearm with electronic ignition that is compact, light, and can be loaded and fired rapidly.

SUMMARY OF THE INVENTION

The present invention provides an improved firearm with electronic ignition, and overcomes the above-mentioned disadvantages and drawbacks of the prior art. As such, the general purpose of the present invention, which will be described subsequently in greater detail, is to provide an improved firearm with electronic ignition that has all the advantages of the prior art mentioned above.

To attain this, the preferred embodiment of the present invention essentially comprises a frame defining an ammunition receptacle having an open lower end and a closed upper end and opposed lateral sidewalls, a plurality of barrels connected to the frame, each barrel having a rear end aperture providing communication with the ammunition receptacle, an ammunition cartridge adapted to be closely and removably received in the ammunition receptacle in an operation position between the opposed lateral sidewalls, the ammunition cartridge having a plurality of ammunition elements, and each ammunition element being registered with a corresponding one of the barrels. Each ammunition element may include a chamber tube element containing propellant and projectile. Each chamber tube element may include a pressure containment member adapted to contain pressures associated with discharge. Each barrel may define a barrel axis, and the barrel axes may be parallel to each other. The ammunition receptacle may be an elongated passage having a passage axis perpendicular to each barrel axis. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
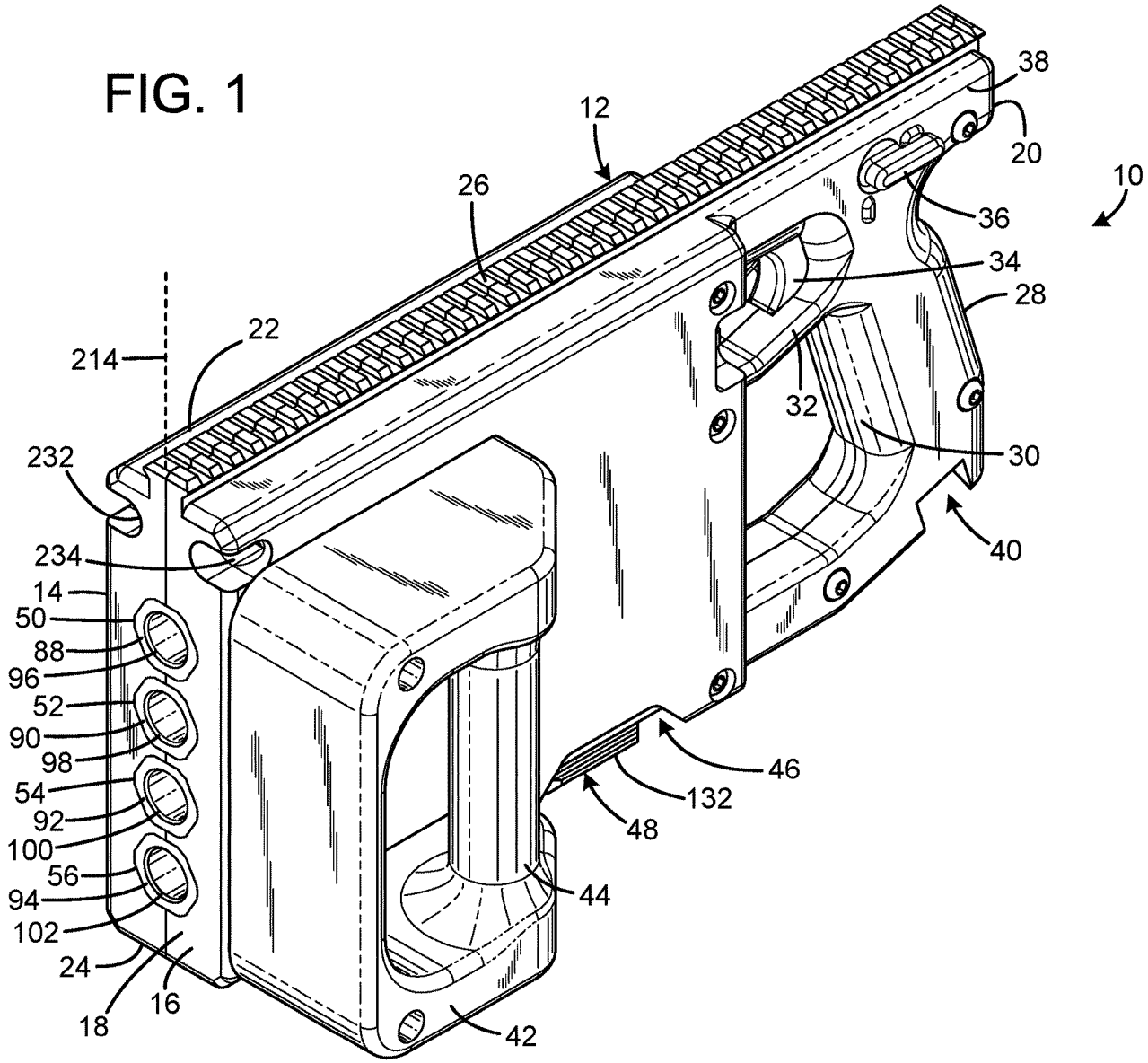
FIG. 1 is a front isometric view of the current embodiment of the firearm with electronic ignition constructed in accordance with the principles of the present invention.

An embodiment of the firearm with electronic ignition of the present invention is shown and generally designated by the reference numeral 10.

Figure 2:
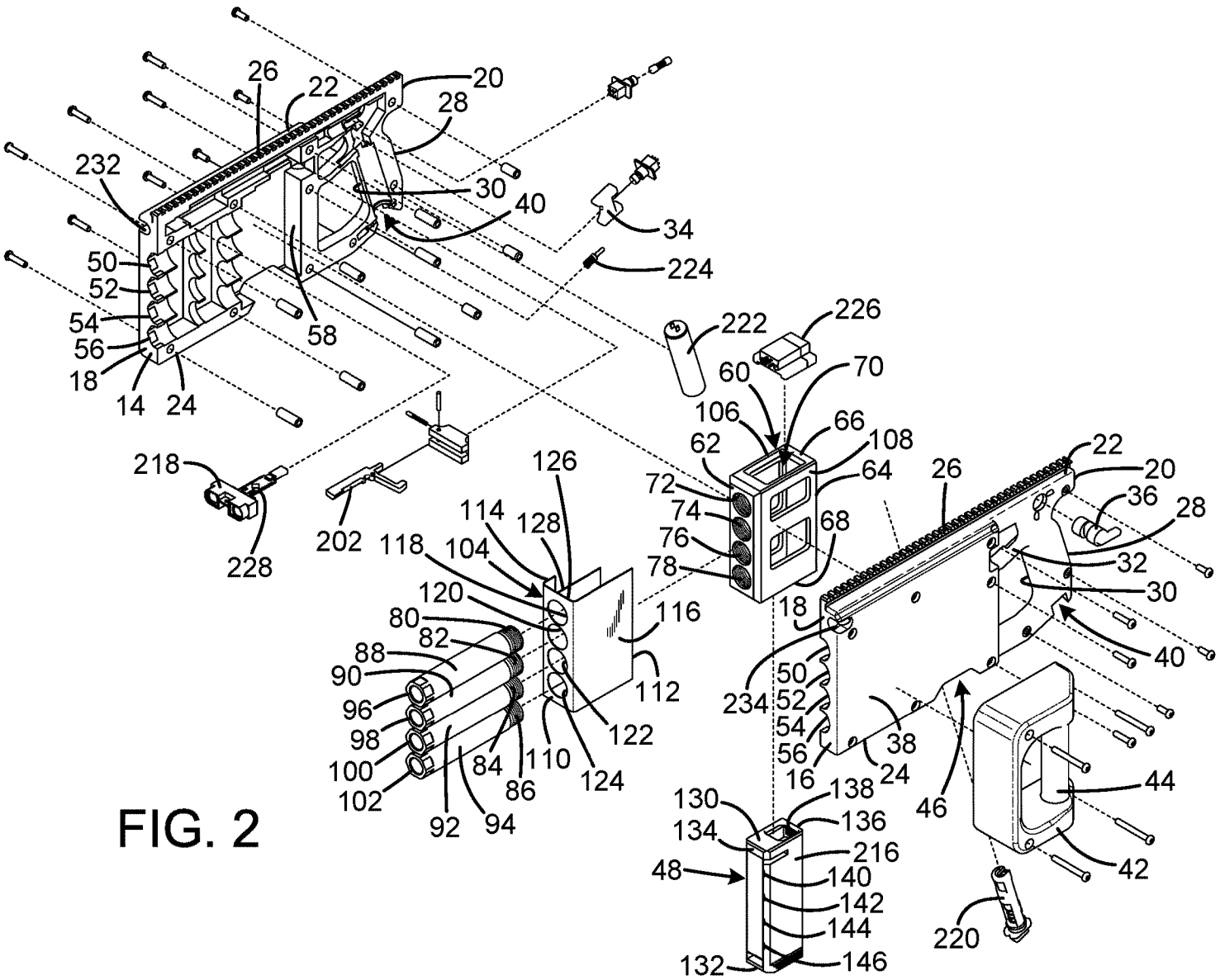
FIG. 2 is an exploded view of the current embodiment of the firearm with electronic ignition of FIG. 1.
Figure 3:
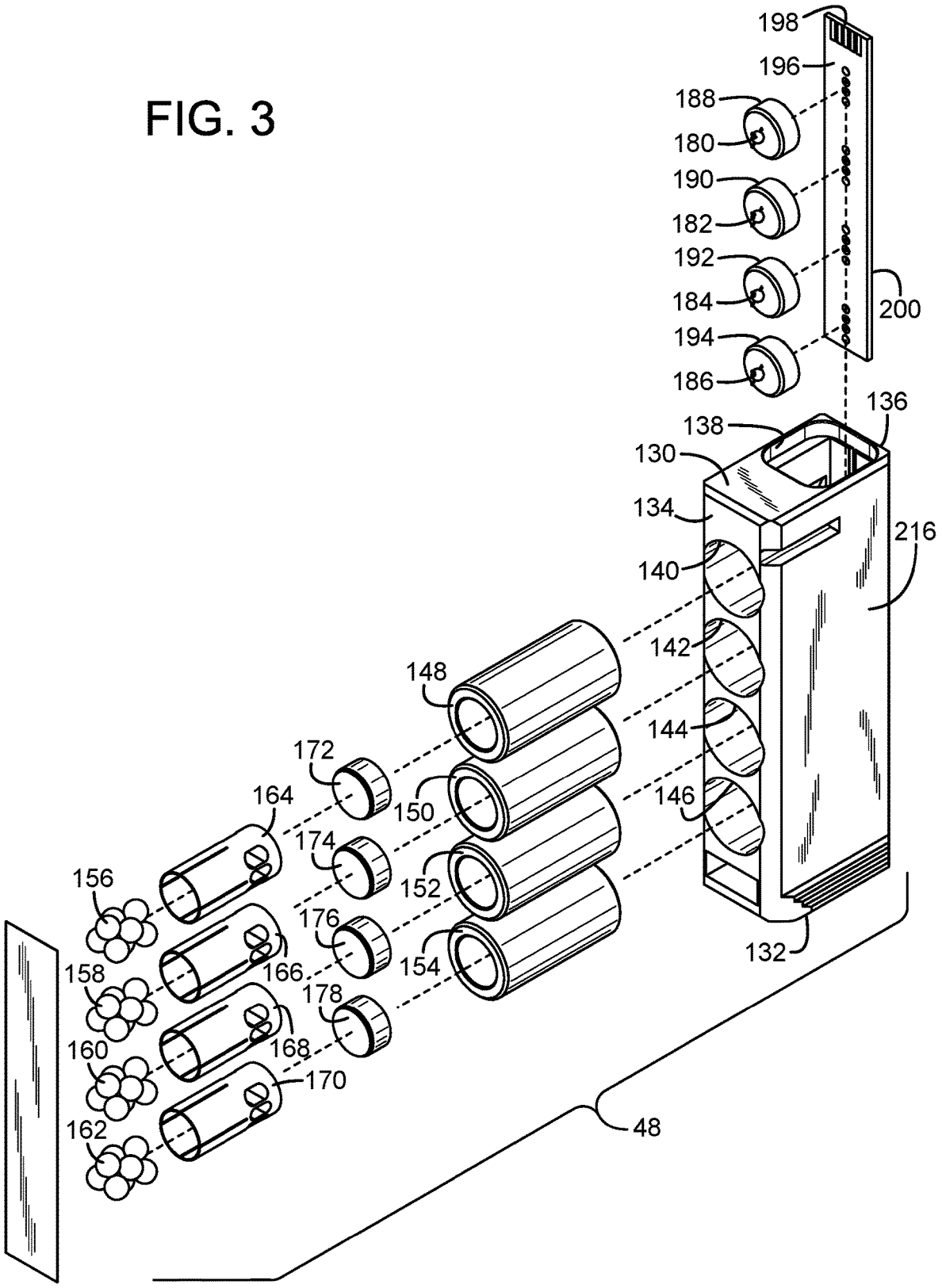
FIG. 3 is an exploded view of the current embodiment of the ammunition cartridge of FIG. 1.
Figure 4:
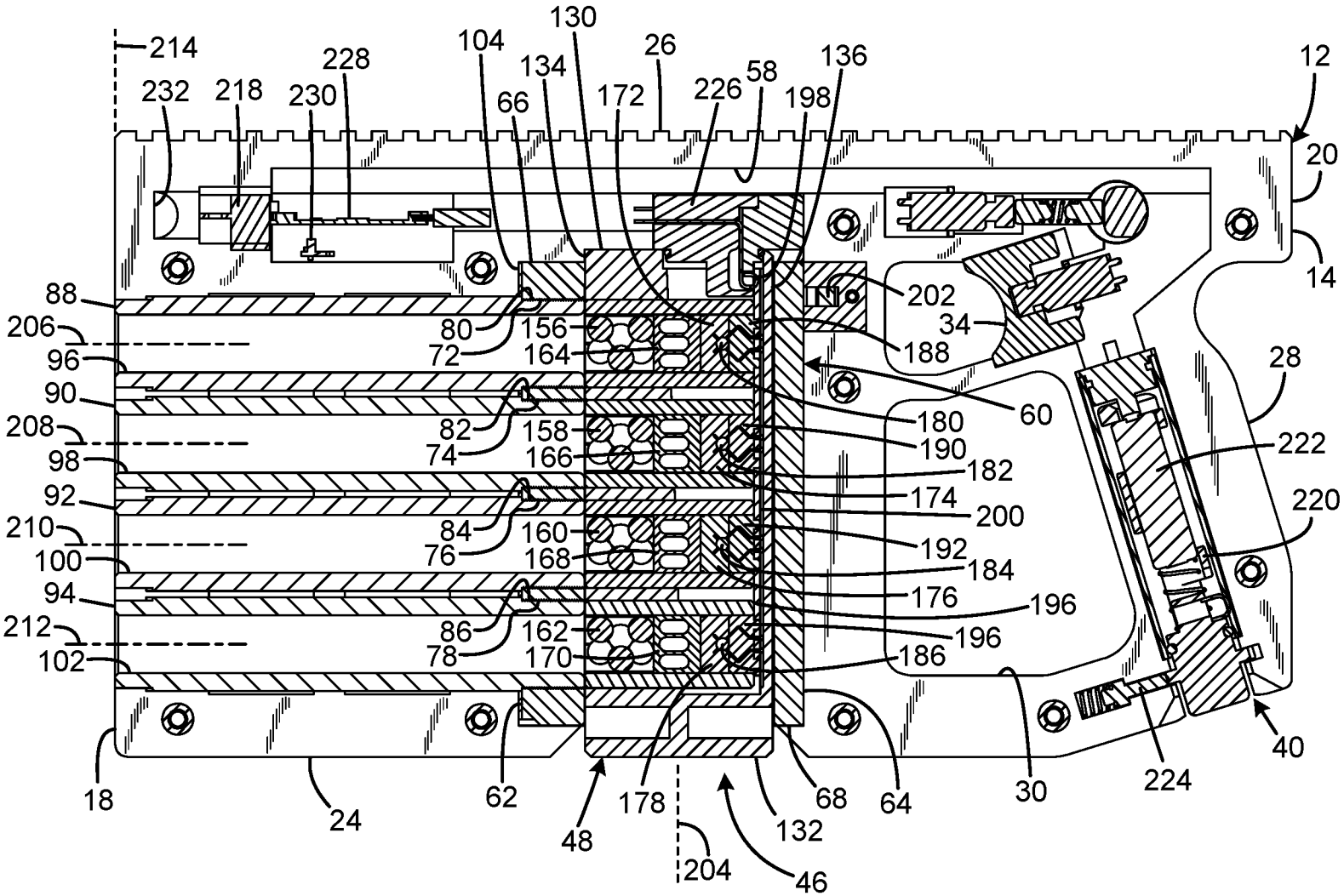
FIG. 4 is a side sectional view of the current embodiment of the firearm with electronic ignition of FIG. 1. Wiring is not shown.

FIGS. 1, 2, and 4 illustrate the improved firearm with electronic ignition 10 of the present invention. FIG. 3 illustrates the improved ammunition cartridge 48 of the present invention. More particularly, the firearm with electronic ignition has a frame 12 consisting of a right half 14 and a left half 16. All the internal parts are captured between the right and left halves. The frame is held together by screws and threaded inserts. Although many of the features of the frame that will be described result from the mating of the right half with the left half, the features of the frame will be described as if the frame were of unitary construction. The frame has a front 18, rear 20, top 22, and bottom 24. The top of the frame includes a full-length Picatinny rail 26. The rear forms a rear grip 28 adapted for gripping by a user, defines a rear grip aperture 30, and forms a trigger guard 32. A trigger 34 protrudes forwardly from the rear grip into a space defined by the trigger guard. A selector switch 36 is rotatably attached to the left side 38 of the frame. The bottom rear of the frame defines a battery tray slot 40 located below the rear grip. The left front of the frame includes a housing 42 having a foregrip 44 adapted for gripping by a user. The bottom of the frame immediately behind the foregrip defines an ammunition receptacle 46 that receives an ammunition cartridge 48. The front of the frame defines four barrel apertures 50, 52, 54, 56. In the current embodiment, the barrel apertures are arranged in a vertical column.

The frame 12 has a hollow interior 58 that receives a receiver 60. The receiver has a front 62, rear 64, top 66, and lower end portion 68. The rear of the receiver is a solid back wall free of openings in the current embodiment. The receiver defines a central passage 70 that extends from the top to the bottom. The central passage is registered with the ammunition receptacle 46 in the frame. The front of the receiver defines four internally threaded apertures 72, 74, 76, 78. In the current embodiment, the internally threaded apertures are arranged in a vertical column. Each internally threaded aperture receives an externally threaded rear end portion 80, 82, 84, 86 of a barrel 88, 90, 92, 94. In the current embodiment, the barrels are arranged in a vertical column. Each barrel has an opposing muzzle 96, 98, 100, 102 that is received by the barrel apertures 50, 52, 54, 56 in the front 18 of the frame. In the current embodiment, the barrels have smooth bores, and the muzzles are hexagonal shaped to accept a wrench to facilitate installation of the threaded rear end portions of the barrels in the internally threaded apertures of the receiver. The barrels are torqued so the muzzles are all oriented the same.

The ammunition cartridge 48 has a top 130, bottom 132, front 134, and rear 136. The top of the ammunition cartridge defines a socket 138. The ammunition cartridge includes four ammunition elements/chamber tube elements 140, 142, 144, 146, each of which holds one round. Each chamber tube element includes a pressure containment member 148, 150, 152, 154, which is a tubular casing that acts as a chamber and contains the pressure when the round is fired. The pressure containment members are press fit into the front of the ammunition cartridge. Inside each chamber tube element is a cluster of projectiles 156, 158, 160, 162, a wad 164, 166, 168, 170, a powder charge/propellant 172, 174, 176, 178, and an electronic primer 180, 182, 184, 186. The rear inside edge of each barrel 88, 90, 92, 94 is beveled so the wad and projectiles can smoothly slide between the pressure containment member and the barrel. Each primer consists of two electrically conductive wires, a plastic plug 188, 190, 192, 194 molded around the two wires, a filament that bridges the two wires, and a protective priming compound that encloses the filament. The filament is made of a material that incandesces when an electrical current is passed through it. The filament can be attached to the wires by winding the filament around the wires, by gluing the filament to the wires, by welding the filament to the wires, or by any other suitable attachment method. The priming compound is applied as a liquid or paste and completely encapsulates the filament. The priming compound solidifies to protect and support the filament. The encapsulation of the filament by the priming compound helps to contain the heat of the filament so the priming compound ignites as quickly as possible when an electrical current is passed through the filament. The priming compound contains its own oxidizer. The four electronic primers are soldered to the back 200 of a printed circuit board 196 and trimmed. The top 198 of the circuit board extends into the socket of the ammunition cartridge. Pads on the top of the circuit board provide an electrical interface between the firearm with electronic ignition 10 and the ammunition cartridge by interfacing with an ammunition cartridge contact assembly 226. The ammunition cartridge contact assembly includes contacts that slide against the pads on the circuit board when the ammunition cartridge is loaded into the firearm. The contacts apply constant pressure against the pads to create an electrical connection. In the current embodiment, the pads connect to the traces on the back of the printed circuit board using through hole vias.

The ammunition cartridge 48 is adapted to be closely and removably received in the ammunition receptacle 46 in an operation position. A cartridge catch 202 releasably secures the ammunition receptacle in the operation position by locating the ammunition cartridge at the correct height inside the receiver 60. The ammunition receptacle is an elongated vertical passage having a passage axis 204. The passage axis is perpendicular to barrel axes 206, 208, 210, 212 defined by each barrel 88, 90, 92, 94. The barrel axes are parallel to each other. The ammunition receptacle is defined by both an opening in the bottom 24 of the frame 12 (an open lower end) and the central passage 70 of the receiver 60. The ammunition receptacle also has a closed upper end, a closed rear side, and opposed lateral sidewalls. The ammunition cartridge has an external form, and the ammunition elements/chamber tube elements 140, 142, 144, 146 are immovable with respect to the external form. The ammunition cartridge includes a body 216 permanently encapsulating at least a portion of each ammunition element/chamber tube element such that the ammunition element/chamber tube element is not removable from the body. An optional cartridge seal in the form of an adhesive tape can be applied over the front 134 of the ammunition cartridge to keep the projectiles 156, 158, 160, 162 in place and seal out moisture and other contaminants from the ammunition element/chamber tube elements.

A heat shield 104 encloses the front 62, right side 106, and left side 108 of the receiver 60. The heat shield has a front 110, rear 112, right side 114, and left side 116. The front of the heatshield defines four barrel apertures 118, 120, 122, 124. The top 126 of the right side of the heatshield defines a slot 128. The cartridge catch 202 engages a slot (not shown) in the right side of the receiver that is exposed by the slot in the right side of the heat shield. In the current embodiment, the receiver is formed of metal, and the frame/housing 12 is formed of a different material (polymer). The heatshield protects the frame from heat resulting from the discharge of one or more rounds in the ammunition elements 140, 142, 144, 146.

The frame/housing 12 receives the receiver 60 and barrels 88, 90, 92, 94, and encompasses all the barrels and the receiver except for the muzzle ends 96, 98, 100, 102 of each barrel and the lower end portion 68 of the receiver to provide access to the ammunition receptacle 46. The muzzles 96, 102 of the uppermost barrel 88 and lowermost barrel 94 define a muzzle line 214. The firearm with electronic ignition 10 includes at least an additional intermediate barrel having a muzzle on the muzzle line.

The firearm with electronic ignition 10 is a handheld 12-gauge firearm that is semi-automatic or fully automatic, and electronically primed. The rate of fire is determined by a value in a line of code. Depending on the programming, pulling the trigger 34 once can fire one round, fire multiple rounds in succession, or fire multiple rounds at once. The firearm with electronic ignition 10 can fire four rounds before the ammunition cartridge 48 is expended. The firearm with electronic ignition 10 can be fired with one or two hands. The cartridge catch 202 is ambidextrous. The selector switch 36 and vertical foregrip 44 can be configured for left- or right-handed users. The firearm with electronic ignition 10 is essentially solid-state, meaning that during a firing cycle, the trigger is the only part that moves. There is no firing pin or striker. There is no mechanical action to cycle before the firearm with electronic ignition can be fired.

The firearm with electronic ignition 10 is controlled by a microcontroller 228. The microcontroller used for proof-of-concept is an Arduino Micro, but a more compact, purpose-built microcontroller could also be used. A single AA battery 222 sends power to a 5 V step-up circuit 230, which in turn supplies regulated power to the microcontroller. All the electronic elements are sealed from moisture. Some parts are sealed with O-rings, and others are covered with a liquid sealant that solidifies to a protective shell. The firearm with electronic ignition 10 can be used with lethal and less-lethal projectiles 156, 158, 160, 162. An infrared distance sensor 218 is contained in the front 18 of the frame 12. The sensor can detect through apertures 232, 234 if there is a person or object within a predetermined distance of the front of the firearm with electronic ignition 10. If there is not enough clearance in front of the firearm with electronic ignition 10 for acceptable use of rubber bullets, bean bags, etc., the microcontroller will ignore any trigger pull signal, and the firearm with electronic ignition 10 will not fire.

The firearm with electronic ignition 10 is held with the user's strong hand on the rear grip 28 and the support hand on the foregrip 44. Starting with no ammunition cartridge 48 in the firearm and the selector switch 36 in the "OFF" position (horizontal), the user inserts one AA battery 222 into the battery tray 220, then inserts the battery tray into the battery tray slot 40 in the rear grip of the firearm. The user twists the battery tray 90° in either direction to positively lock the battery tray in place with a small detent 224. The user inserts an ammunition cartridge vertically into the receiver 60 through the ammunition receptacle 46 until the ammunition cartridge is locked in position by the cartridge catch 202 in the same manner as loading a magazine into a conventional magazine fed rifle. With the ammunition cartridge in this position, the four ammunition elements/chamber tube elements 140, 142, 144, 146 are axially registered with the four barrels 88, 90, 92, 94. The user then aims the firearm at the target and turns the selector switch to the "ON" position (vertical). This closes a double pole double throw (DPDT) switch to route power from the battery to the microcontroller. The microcontroller powers on and begins running its main program loop, waiting for input from the trigger 34.

When the trigger 34 is pulled/depressed, a second DPDT switch is closed, and the microcontroller begins an event sequence. The microcontroller routes power to the distance sensor 218, and the distance sensor takes three or more readings in a fraction of a second. To minimize error, the program checks that the sensed distance values are within a predetermined percentage of each other. If the readings are too erratic, the program ignores the trigger pull and returns to its main program loop. If the readings match, the program considers the reading valid and continues to the next step.

If the distance reading is less than or equal to the predetermined distance setting, the program ignores the trigger pull and returns to its main program loop. If the distance reading is greater than the predetermined distance setting, the microcontroller references the current round value and routes power through the selector's DPDT switch, through the trigger's DPDT switch, through the ammunition cartridge contacts/pads, through the ammunition cartridge circuit board 196, and through the filament of the current round's primer (at least one of 180, 182, 184, 186). The filament incandesces until the priming compound ignites and fires the round. The program cycles the stored round value to the next round in the sequence. The program then returns to its main program loop and the firearm is ready to be fired again. At this point, the user has the option of turning the selector to the "OFF" (horizontal) position to power down the microcontroller. When the selector is returned to "ON" (vertical), the microcontroller will power on and be able to recall the position of the last round fired.

Once all four of the rounds are expended, the user turns the selector switch 36 to "OFF" (horizontal) with the strong thumb, and depresses the cartridge catch 202 on either the right or left side of the firearm with electronic ignition 10 with the strong forefinger. With the cartridge catch depressed, the user pulls the ammunition cartridge 48 out of the ammunition receptacle 46 with the support hand. The spent ammunition cartridge is discarded, and the firearm is ready to accept a new ammunition cartridge.

While a current embodiment of a firearm with electronic ignition has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Many variations of the firearm with electronic ignition are possible. The cartridge and receiver could be tapered to facilitate tighter lockup and easier extraction. The firearm could have multiple barrels arranged in an array instead of a vertical line. The microcontroller could be programmed for automatic fire, with different fire modes from which to choose. One fire mode could be a balanced muzzle-climb mode. In this mode, rounds would be fired in pairs from barrels that are opposite of each other, so that virtually no moment is imparted on the firearm. This would effectively eliminate muzzle climb. There could be more than five pads on the circuit board. The barrels could be rifled. Each barrel could fire one projectile or multiple projectiles at one time. The firearm could incorporate a switch that activates whenever the cartridge catch is not in the "LOCKED" position. Activating the switch could signal to the microcontroller that a new ammunition cartridge has been loaded and the firing sequence could be reset. It could also provide an out-of-battery safety, whereby electricity must flow through the switch before it reaches any primer. The switch would likely be a DPDT momentary NC type. The trigger could incorporate a drop safety. The firearm could incorporate an electronic or mechanical grip safety. The distance sensor could use infrared, ultrasound, or other means to measure distance. The accessory rail could contain electrical contacts that route power from the firearm's battery to the accessories. The switches could be of different types, such as rotary selectors, optical sensors, magnetic induction switches, or others. The firearm could incorporate mounting points for a shoulder stock. The firearm could incorporate a sensor that can determine the angle that the firearm is aimed. If the firearm is aimed too high, the microcontroller could prevent the firearm from firing. If the firearm user and the target are both of average height and standing on level ground, the effect would be that the firearm would not fire if it was aimed at the target's head. This application would be for riot control using less-lethal ammunition. Different receivers could be made for lethal and less-lethal applications. The less-lethal receiver could have a protrusion and the ammunition cartridge could have a corresponding notch so that lethal ammunition could not be inserted into the receiver. The less-lethal receiver could be sized for smaller cartridges, so that lethal ammunition would not fit into the receiver. The lethal version could use a different electrical interface between the cartridge and the electrical contacts. The cartridge could contain an electronic means of identifying itself to the microcontroller. Something as simple as the presence or omission of an electrical connection on the cartridge PCB could be used. The firearm could include a digital display that would show how many rounds remain in the cartridge. The display could also show battery status, range to target, or other information. Battery status could be indicated by a separate display or by LEDs. The firearm could include an RFID reader that would identify a tag on each cartridge to determine which settings to use. An RFID reader in either the rear grip or the foregrip could be paired with a tag that is located on the user's person. The correct tag would be required to activate the firearm. The firearm could include a wireless receiver. The program could require that an authorization code be detected by the wireless receiver to enable the firearm to fire. It could be a one-time signal to unlock or lock the firearm, or the firearm could require a continuous signal to stay unlocked. The firearm could omit the foregrip. The user would hold the rear grip in the same way as they would hold a handgun. The user could hold the rear grip with their strong hand and hold the bottom of the frame with their support hand. The frame could feature hand stops under the barrels that prevent the support hand from moving in front of the muzzle or behind the barrels. The frame halves are designed to be injection molded with a two-part mold, but they could be manufactured in other ways, such as milling or 3D printing. The receiver is designed to be milled from a billet of steel, but it could be made from rectangular tubing or another material.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a frame defining an ammunition receptacle having an open lower end, a closed upper end, a closed rear side, and opposed lateral sidewalls;

a plurality of barrels connected to the frame;

each barrel having a rear end aperture providing communication with the ammunition receptacle;

an ammunition cartridge adapted to be closely and removably received in the ammunition receptacle in an operation position between the opposed lateral sidewalls;

the ammunition cartridge having a plurality of ammunition elements;

each ammunition element being registered with a corresponding one of the barrels; and wherein each ammunition element includes a chamber tube element containing propellant and projectile.

2. The firearm of claim 1 wherein each chamber tube element includes a pressure containment member adapted to contain pressures associated with discharge.

3. The firearm of claim 1 wherein each barrel defines a barrel axis, and the barrel axes are parallel to each other.

4. The firearm of claim 3 wherein the ammunition receptacle is an elongated passage having a passage axis perpendicular to each barrel axis.

5. The firearm of claim 1 wherein the barrels are arranged in a vertical column.

6. The firearm of claim 1 wherein the frame includes a housing adapted for gripping by a user, and includes a receiver received in the housing and defining the ammunition receptacle.

7. The firearm of claim 6 wherein the receiver and housing are formed of different materials.

8. The firearm of claim 7 wherein the receiver is formed of metal and the housing is formed of polymer.

9. The firearm of claim 6 wherein each of the barrels has an externally threaded rear end portion, and the receiver defines a plurality of internally threaded apertures each receiving a barrel's threaded rear end portion.

10. The firearm of claim 9 wherein the receiver and barrels are received in an outer housing.

11. The firearm of claim 10 wherein the housing encompasses all of the barrels and the receiver except for a muzzle end of each barrel and a lower end portion of the receiver to provide access to the ammunition receptacle.

12. The firearm of claim 6 wherein the receiver has a solid back wall free of openings.

13. The firearm of claim 1 including more than two barrels.

14. The firearm of claim 1 including at least four barrels.

15. The firearm of claim 1 including an uppermost barrel and a lowermost barrel each with a respective muzzle, the respective muzzles defining a muzzle line, and including at least an additional intermediate barrel having a muzzle on the muzzle line.

16. The firearm of claim 1 wherein the ammunition elements are immovable with respect to each other.

17. The firearm of claim 1 wherein the ammunition cartridge has an external form and wherein the ammunition elements are immovable with respect to the external form.

18. The firearm of claim 1 wherein the ammunition cartridge includes a body permanently encapsulating at least a portion of each ammunition element such that the ammunition elements are not removable from the body.

19. A firearm comprising:

a frame defining an ammunition receptacle having an open lower end, a closed upper end, a closed rear side, and opposed lateral sidewalls;

a plurality of barrels connected to the frame;

wherein each barrel defines a barrel axis, and the barrel axes are parallel to each other;

wherein the ammunition receptacle is an elongated passage having a passage axis perpendicular to each barrel axis;

each barrel having a rear end aperture providing communication with the ammunition receptacle;

an ammunition cartridge adapted to be closely and removably received in the ammunition receptacle in an operation position between the opposed lateral sidewalls;

the ammunition cartridge having a plurality of ammunition elements; and each ammunition element being registered with a corresponding one of the barrels.

20. A firearm comprising:

a frame defining an ammunition receptacle having an open lower end, a closed upper end, a closed rear side, and opposed lateral sidewalls;

wherein the frame includes a housing adapted for gripping by a user, and includes a receiver received in the housing and defining the ammunition receptacle;

a plurality of barrels connected to the frame;

wherein each of the barrels has an externally threaded rear end portion, and the receiver defines a plurality of internally threaded apertures each receiving a barrel's threaded rear end portion;

each barrel having a rear end aperture providing communication with the ammunition receptacle;

an ammunition cartridge adapted to be closely and removably received in the ammunition receptacle in an operation position between the opposed lateral sidewalls;

the ammunition cartridge having a plurality of ammunition elements; and each ammunition element being registered with a corresponding one of the barrels.

21. A firearm comprising:

a frame defining an ammunition receptacle having an open lower end, a closed upper end, a closed rear side, and opposed lateral sidewalls;

wherein the frame includes a housing adapted for gripping by a user, and includes a receiver received in the housing and defining the ammunition receptacle;

wherein the receiver has a solid back wall free of openings;

a plurality of barrels connected to the frame;

each barrel having a rear end aperture providing communication with the ammunition receptacle;

an ammunition cartridge adapted to be closely and removably received in the ammunition receptacle in an operation position between the opposed lateral sidewalls;

the ammunition cartridge having a plurality of ammunition elements; and each ammunition element being registered with a corresponding one of the barrels.

22. A firearm comprising:

a frame defining an ammunition receptacle having an open lower end, a closed upper end, a closed rear side, and opposed lateral sidewalls;

a plurality of barrels including more than two barrels connected to the frame;

each barrel having a rear end aperture providing communication with the ammunition receptacle;

an ammunition cartridge adapted to be closely and removably received in the ammunition receptacle in an operation position between the opposed lateral sidewalls;

the ammunition cartridge having a plurality of ammunition elements; and each ammunition element being registered with a corresponding one of the barrels.

23. A firearm comprising:

a frame defining an ammunition receptacle having an open lower end, a closed upper end, a closed rear side, and opposed lateral sidewalls;

a plurality of barrels including at least four barrels connected to the frame;

each barrel having a rear end aperture providing communication with the ammunition receptacle;

an ammunition cartridge adapted to be closely and removably received in the ammunition receptacle in an operation position between the opposed lateral sidewalls;

the ammunition cartridge having a plurality of ammunition elements; and each ammunition element being registered with a corresponding one of the barrels.

24. A firearm comprising:

a frame defining an ammunition receptacle having an open lower end, a closed upper end, a closed rear side, and opposed lateral sidewalls;

a plurality of barrels connected to the frame including an uppermost barrel and a lowermost barrel each with a respective muzzle, the respective muzzles defining a muzzle line, and including at least an additional intermediate barrel having a muzzle on the muzzle line;

each barrel having a rear end aperture providing communication with the ammunition receptacle;

an ammunition cartridge adapted to be closely and removably received in the ammunition receptacle in an operation position between the opposed lateral sidewalls;

the ammunition cartridge having a plurality of ammunition elements; and each ammunition element being registered with a corresponding one of the barrels.

25. A firearm comprising:

a frame defining an ammunition receptacle having an open lower end, a closed upper end, a closed rear side, and opposed lateral sidewalls;

a plurality of barrels connected to the frame;

each barrel having a rear end aperture providing communication with the ammunition receptacle;

an ammunition cartridge adapted to be closely and removably received in the ammunition receptacle in an operation position between the opposed lateral sidewalls;

the ammunition cartridge having a plurality of ammunition elements;

wherein the ammunition cartridge includes a body permanently encapsulating at least a portion of each ammunition element such that the ammunition elements are not removable from the body; and each ammunition element being registered with a corresponding one of the barrels.

* * * * *